United States Patent [19]

Nasu

[11] 4,455,951

[45] Jun. 26, 1984

[54] EMBROIDERY LACE MACHINE DRIVEN BY ELECTRIC SIGNALS

[75] Inventor: Hiroshi Nasu, Kawagoeshi, Japan

[73] Assignee: Hiraoka Kogyo Kabushiki Kaisha, Hannoshi, Japan

[21] Appl. No.: 511,474

[22] Filed: Jul. 7, 1983

[30] Foreign Application Priority Data

Sep. 8, 1982 [JP] Japan ..... 57-155204

[51] Int. Cl.[3] ..... D05C 5/02

[52] U.S. Cl. ..... 112/84; 112/79 A; 112/121.11

[58] Field of Search ..... 112/84, 85, 86, 83, 112/79 A, 158 E, 121.11

[56] References Cited

U.S. PATENT DOCUMENTS 3,005,137 10/1961 Caron ..... 112/84 X
3,266,448 8/1966 Haggar ..... 112/84
3,752,095 8/1973 Brown et al. ..... 112/79 A
3,972,295 8/1976 Smith ..... 112/79 A
4,173,192 11/1979 Schmidt et al. ..... 112/79 A

*Primary Examiner*—H. Hampton Hunter
*Attorney, Agent, or Firm*—Oblon, Fisher, Spivak, McClelland & Maier

[57] ABSTRACT

An embroidery lace machine is driven by electric signals. A plurality of selection plates control a jacquard and can move horizontally in response to control elements. A reset bar returns the selection plates to their original positions. In one embodiment, the control elements consist of plates aligned with the selection plates and biased into contact with the selection plates. Electrically actuated solenoids selectively prevent movement of selected ones of the control elements. In a second embodiment, the control elements are wires selectively engageable with a sliding plate. Electrically actuated solenoids are provided for selectively connecting the control elements with the sliding plate.

5 Claims, 11 Drawing Figures

EMBROIDERY LACE MACHINE DRIVEN BY ELECTRIC SIGNALS

BACKGROUND OF THE INVENTION

1. Field of the Invention

This invention relates to embroidery lace machines driven by electric signals.

2. Description of the Prior Art

The conventional embroidery lace machine locates the embroidering position, has a punching machine to embroider the desired pattern, and uses a pattern card with a pattern of holes for the stitches of the embroidery.

Recently, an embroidery machine designed to save man-power for punching and called an electronic punching machine has appeared, which has a built-in computer and allows one to make pattern paper to fill the interior embroidery stitching by locating several positions by inputting the width of the embroidery and the distance from the next thread. Therefore, the pattern itself can be made in a short time by use of a computer. However, it is required to make a pattern card with predetermined holes, and this was inefficient because of the time necessary for preparing the pattern card.

The conventional embroidery machine is provided with supporting members 2 and 2' at the front and back ends of the base stand 1, and lower support members 4 and 4', each having a plurality of grooves 3 and being fixed to the supporting members 2 and 2'. Each pair of grooves 3 is fitted with selection plates 4 which are free to move on the support members. The upper surfaces of the selection plate 5 are supported by upper guide members 7 and 7' having grooves 6 corresponding to the grooves 3 of the lower guide members 4 and 4'. Further, to one end of each selection plate 5 is attached a horizontally oriented operation bar 8. A wire fork 9 is attached to the upper face of the other end of each plate 5 and the other end of each wire fork 9, although not shown in the drawings, is connected to a signal originating device which controls a jacquard. Rotating cylinder 11, onto which pattern cards 10 are held, faces the distal end of the operation bar 8. Reset bar 12 is positioned below the wire fork 9. The reset bar 12 and rotating cylinder 11 are connected by connecting rods 14 and 14' which are inserted through the brackets 13 and 13'.

At the reset bar 12 side end of both connecting bars 14 and 14' are pivotally attached links 15 and 15'. Links 15 and 15' are also pivotally attached to the supporting pieces 17 and 17' which are fixed to a rotary shaft 16. The rotary shaft 16 is pivotally attached to the upper end of the up and down bar 17 through the lever 16' at the end of the shaft 16. The lower end of the up and down bar 18 is pivotally attached to rocking piece 21 which is caused to pivot about its central axis by contact with the cam 20 on the main shaft 19. Shaft 16 is rotated clockwise or counterclockwise by the up and down motion of the up and down bar 18 via the lever 16', and the connecting bars 14 and 14' are thus caused to reciprocate in the direction of the arrow in FIG. 1.

Incidentally, element 22 in the drawing is the holding plate of selection plates 5. Plate 22 is fixed to the projecting support pieces 23 and 23' which are fixed to the brackets 13 and 13'.

In the prior art, the up and down bar 18 is moved up and down by the rotation of the main shaft 19, and the rotary shaft 16 is rotated to horizontally reciprocate the connecting bars 14 and 14', and to make rotating cylinder 11 and reset bar 12 reciprocate. Then, the rotating cylinder 11 and reset bar 12 are moved to the left side in the Figures.

When this happens, the selection plate 5 in the place where no hole exists on the pattern card 10 is shifted to the left by pattern card 10 via the operation bar 8 and the wire fork 9 is moved as shown in FIG. 2(B), so as to control the signal originating device. The selection plate 5 which is located at a position corresponding to a hole of the pattern card 10 does not move, because the operation bar 8 enters the hole as shown in FIG. 2(C). Therefore, the wire fork 9 does not move.

Accordingly, a signal is sent out corresponding to the position where the selection plate 5 and the wire fork 9 do not move, to control the jacquard through various mechanisms.

After the signal is sent out, connecting bars 14 and 14' are moved to the right side by the rotation of main shaft 19, and the moved selection plates 5 are returned to their original places by the reset bar 12, and one cycle is completed.

Therefore, the movement of the selection plate 5 is performed by the pattern card 10, resulting in the use of the same pattern card 10 repeatedly so that the pattern card deteriorates. Therefore, it is necessary to have many of the same pattern cards prepared. Further, the width of the pattern card must be larger than the selection plate for pushing the selection plate, and must be thick. Thus, the pattern paper of one pattern must be made large, and the mechanism has the disadvantage of requiring a large storage area.

SUMMARY OF THE INVENTION

In consideration of the disadvantages of the conventional mechanism as stated above, this invention does not use pattern paper, and has as its object the furnishing of an embroidering lace machine which is driven by electric signals and which can be controlled by electronic signals.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or correspondings parts throughout the several views, and wherein.

DETAILED DESCRIPTION OF THE PREFERRED EMBODIMENTS

Figure 1:
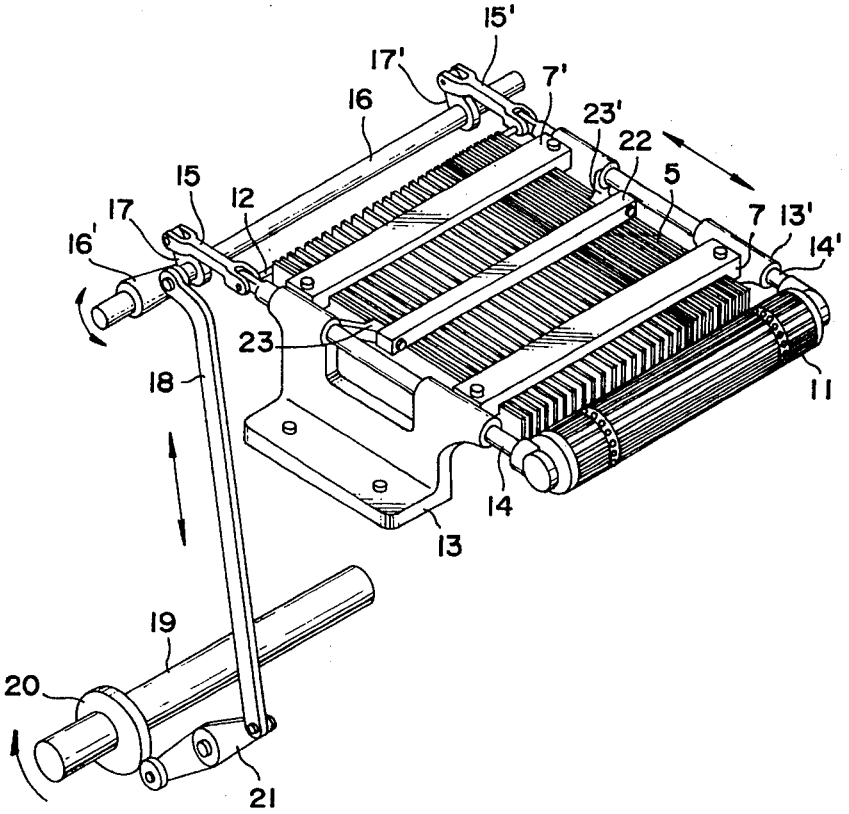
FIG. 1 PRIOR ART
FIG. 1 is a perspective drawing indicating the selection plate part of the conventional embroidering lace machine.
Figure 2A:
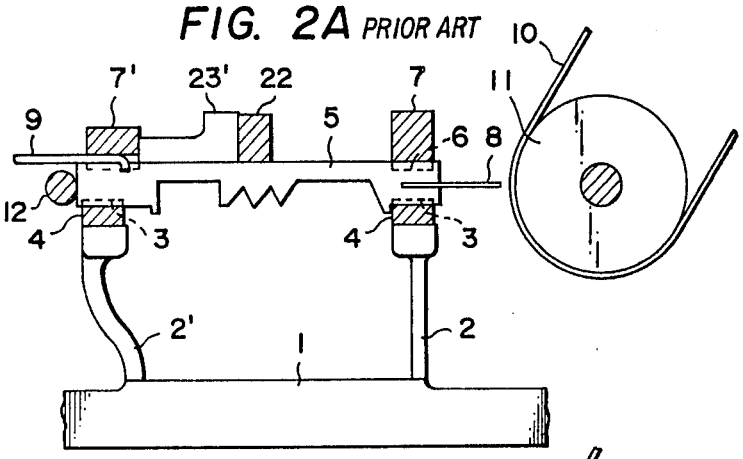
FIG. 2A PRIOR ART
FIGS. 2(A), (B), (C) are sectional drawings schematically indicating the relation between the pattern card and selection plate in the conventional machine.
Figure 2B:
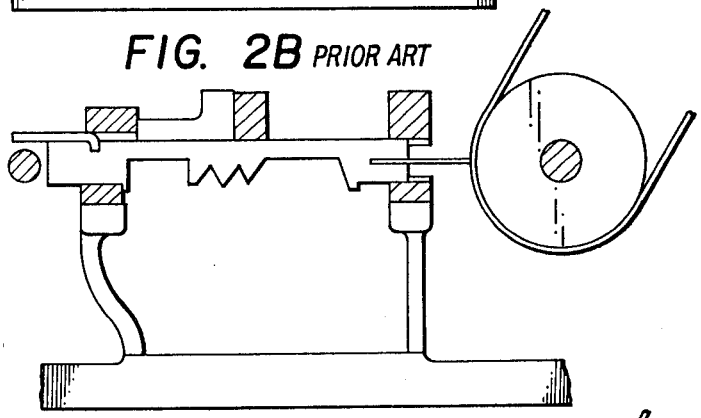
FIG. 2B PRIOR ART
Figure 2C:
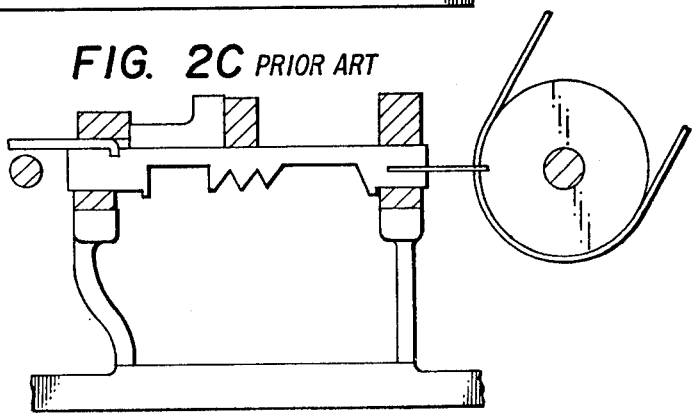
FIG. 2C PRIOR ART
Figures 3, 4, 5:
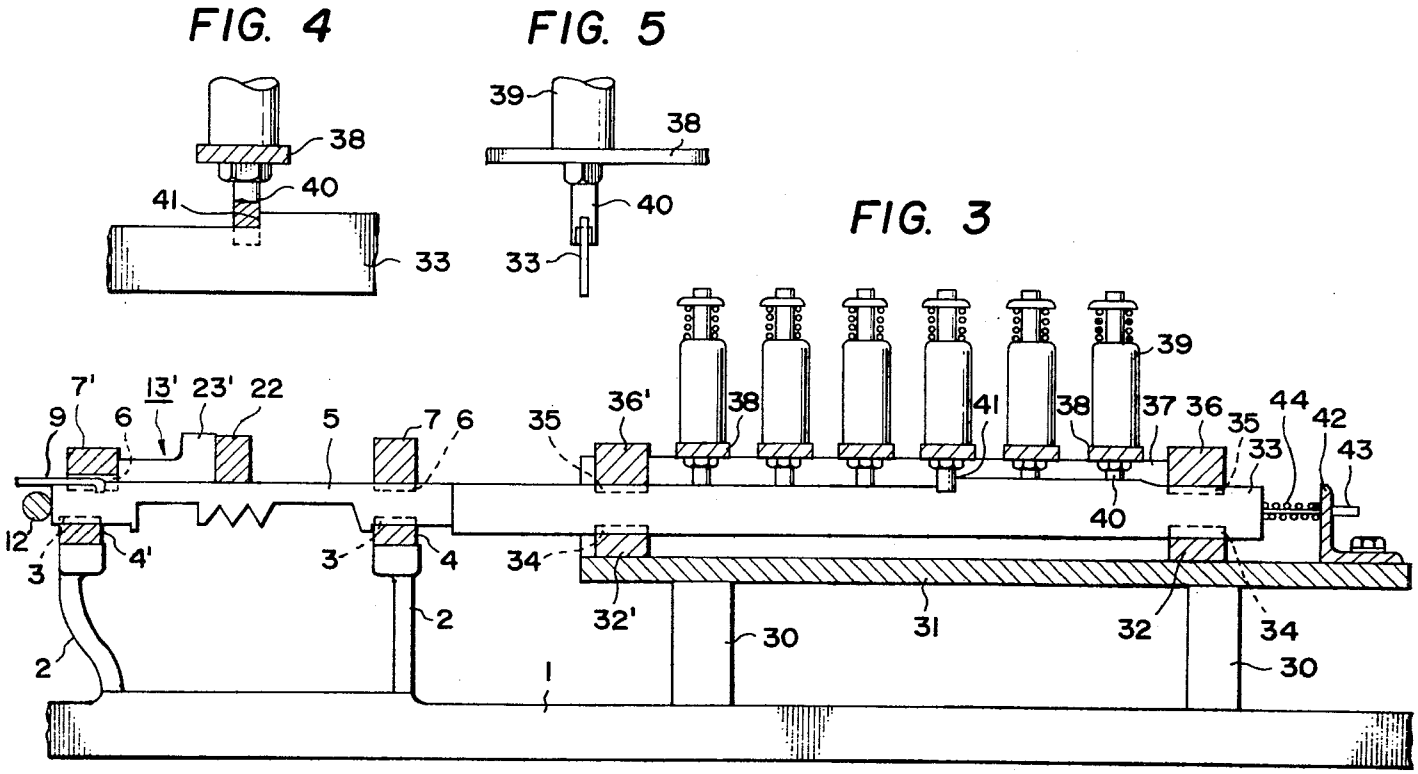
FIG. 3 is a sectional drawing of the embroidering lace machine operated by electric signals according to the first embodiment of this invention.
FIG. 4 is a side view indicating the key portion of the machine of FIG. 4, under solenoid operation.
FIG. 5 is an elevational view at the key portion of FIG. 4.
Figure 6:
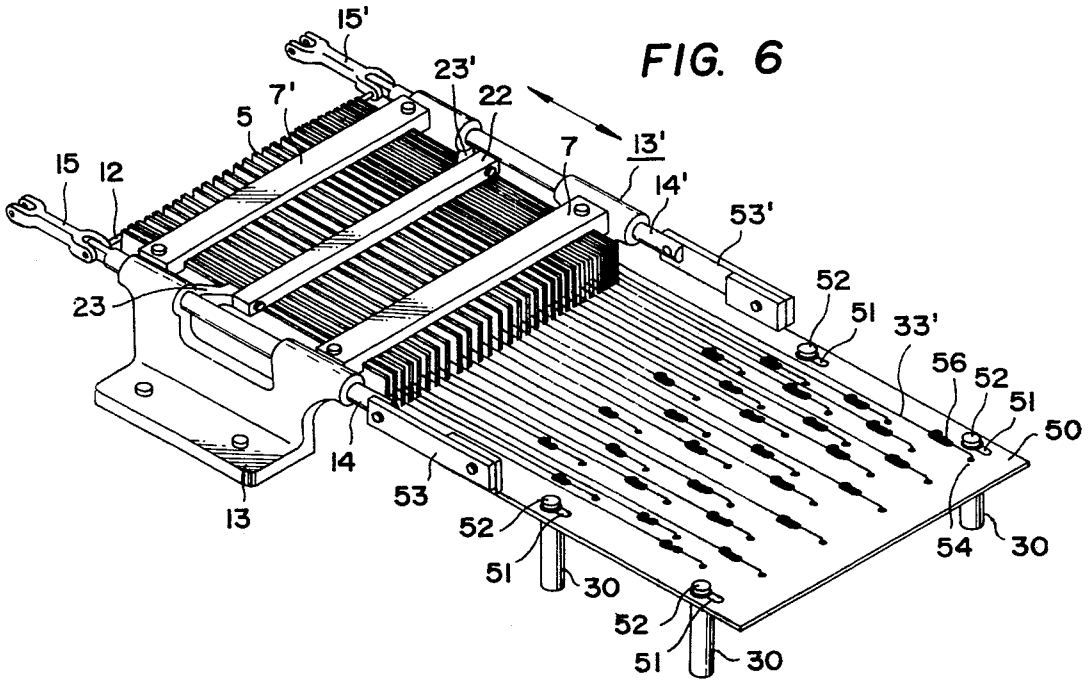
FIG. 6 is a perspective view of a second embodiment.

The first embodiment of the mechanism of this invention is described in detail referring to FIG. 3 through FIG. 5.

Supporting table 31 is supported in front of the supporting member 2 of the base stand 1 via a number of legs 30 and 30, and the lower guide control members 32 and 32', which are parallel with the lower guide member 4, are fixed to the front and rear of the upper face of the supporting table 31. Both of the lower guide control members 32 and 32' have guide grooves 34 into which selection plate control member 33, being formed as a plate and aligned in series with the selection plates 5, will be inserted. Further, upper guide control members 36 and 36', having guide grooves 35 are in contact with the upper surface of the selection plate control member 33, and both sides of members 36 and 26' are fixed to the above described lower guide control members 32 and 32'.

The supporting plates 37 and 37 are fixed to both sides of the upper face of the supporting table 31, and a number of solenoid supporting plates 38 are fixed in parallel to the plate 37. Solenoids 39 are fixed to the solenoid supporting plates 38 with their cores 40 projected beneath the plates 38.

On the other hand, on the upper face of the selection plate control member 33, stepped parts 41 are formed at different places, to which the core bodies 40 are engaged to prevent movement.

Further, L-shaped holding plate 42 is fixed to the upper face of the supporting table 31 at the side opposite the selection plate 5. Operation bars 43 are fixed to the selection plate control members 31 and are inserted through holes in the holding plate 42. A compression spring 44 is mounted on each operation bar 43 between holding plate 42 and a plate member 33 to press each of the selection plate control members 33 towards the selection plate 5.

Other structures are the same as in the conventional machine and the description is abbreviated by assigning to them the same component symbols as in the prior art.

In the first embodiment, when a signal corresponding to the pattern card hole is sent to a solenoid 39, the solenoid 39 operates in the downward direction and makes the core 40 move to engage with the stepped portion 41 of the selection plate control member 33. Then, the reset bar 12 is moved to the left in FIG. 3, by the driving of the main shaft. The selection plates 5 are released from control members 33 by this movement, and the selection plate control members 33, for which solenoids 39 are not functioning are pressed by the compression springs 44, and move the selection plates 5 to the left. Thus, the same operation as in the conventional machines is performed.

The selection control members 33 can either be fixed to the selection plate 5 or may be made separately and be installed in a conventional mechanism.

The second embodiment will now be described in accordance with FIG. 6 through FIG. 9. Four legs 30 are fixed to the front side of the supporting member 2 of the base stand 1, and a sliding plate 50 is installed above these legs 30. Long guide holes 51 are formed in four portions of the sliding plate 50 and extend parallel with the selection plates 5. The sliding plate 50 is movable via the bolts 52 passing through the long holes. Connecting members 53 and 53' are fixed to both sides of the upper face of the supporting member 2 of this sliding plate 50 and are connected to the connecting bars 14 and 14' so that they can be operated jointly with the reset bar 12.

Further, a number of operation holes 54 are drilled in the sliding plate 50 at different places, and an engaging portion 55, formed at an end of each selection control wire 33', is inserted in each operation hole 54. The other end of each wire 33 is connected to a selection plate 5. A long hole 56 for a solenoid 39 is formed in the selection plate 5 adjacent each operation hole 54 and the core body 40 of a solenoid 39 is inserted into a hole 56 from below. Each core body 40 has a selection plate control wire 33' extending through an aperture therein so that wire 33' can move up and down with the movement of the core body 40. Each solenoid 39 is fixed to the fixed supporting plate 58, which is fixed via the supporting member 57 to the base stand 1.

Other structures are the same as in the conventional machine and the description is abbreviated by assigning to them the same component symbol as in the prior art.

Figure 8:
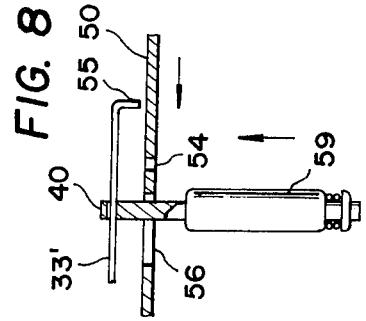
FIG. 8 is a side view indicating the key portion of FIG. 7 when under solenoid operation.
Figure 7:
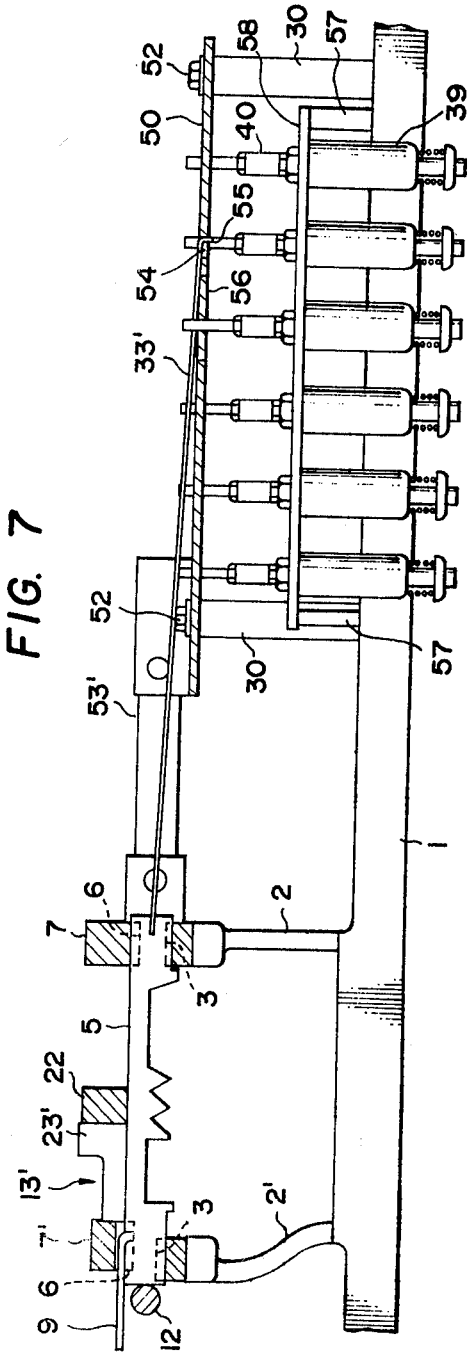
FIG. 7 is a sectional view of FIG. 6.

In the second embodiment, as when a signal corresponding to the hole of the pattern card is sent to a solenoid 39, the core body 40 projects as shown in FIG. 8, making a selection plate control wire 33' to go up so that the engaging portion 55 is released from the engaging hole 54.

Figure 9:
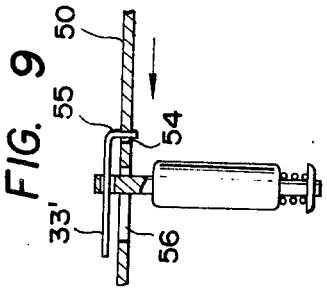
FIG. 9 is a sectional view of the key part of FIG. 7 when the solenoid is not operating.

On the other hand, when the solenoid 39 is in the inoperative condition, the engaging portion 55 of each selection plate control wire 33' is inserted in the engaging hole 54, as shown in FIG. 9.

Therefore, when the reset bar 12 is moved to the left in the figures by driving the main shaft, sliding plate 50 also moves to the left in the drawing, and only those particular selection plate control wires 33' for which solenoid 39 is not operating, move to the left with the sliding plate 50, causing selection plate 5 to move.

Since this invention is constructed for controlling the movement of the selection plate, by which the pattern will be formed, by solenoid control, the control is performed by simply issuing an electric signal to the solenoid.

Consequently, a pattern card is not necessary as in the conventional machine, and the machine can be driven by directly transferring the data of the pattern prepared with an electronic punching machine or by storing the memory on paper tapes for information exchange, cassette tape, memory element, etc., and this simplifies the storage of the pattern. Also, the paper tape, etc., will not be deteriorated because the reading is made electrically from paper tapes etc., and the pattern can be stored semi-permanently.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An embroidery lace machine driven by electric signals, comprising:

a frame;

a plurality of parallel selection plates mounted on said frame, each of said selection plates being horizontally movable on said frame in a first direction between a first position and a second position for controlling a jacquard;

selection plate control means associated with each said selection plate, each said control means being constructed and positioned for selectively moving one of said selection plates from said first position to said second position;

a solenoid mounted on said frame for each said selection plate, each said solenoid being selectively engageable with one of said selection plate control means for selectively actuating selected ones of said control means; and a reset bar associated with said frame at a first end of said selection plates and horizontally movable for moving all of said plates which are in said second position to said first position.

2. The machine of claim 1 wherein said selection plate control means comprises:

a plate shaped control member for each said selection plate, each said control member being slidably mounted on said frame for movement in said first direction, each said control member being in alignment with one of said selection plates and being positioned for movement into abutment with a second end of said selection plate opposite said first end of said selection plate;

spring means for biasing each said control member into abutment with one said selection plate and for biasing said selection plate into said second position; and a notch on a first surface of each said control member, wherein each said solenoid has a core movable into contact with said first surface of one said control member and into contact with said notch when a corresponding one said selection plate is in said first position, whereby an engagement of one said core in one said notch prevents said biasing means from moving one said selection plate into said second position.

3. The machine of claim 1 wherein said selection plate control means comprises:

a single sliding plate slidably mounted on said frame for movement in said first direction, said sliding plate extending transverse to said selection plates adjacent a second end of said selection plates opposite said first end;

connecting means connecting said sliding plate to said reset bar for movement therewith; and a control member for each said selection plate, each said control member having one end connected to one said selection plate and a second end selectively connected to said sliding plate, wherein each said solenoid has a movable core engageable with one said control member for selectively moving said second end of one said control member into and out of connection with said sliding plate, whereby movement of said sliding plate by said reset bar also moves those selection plates whose control members are connected to said sliding plate.

4. The machine of claim 3 wherein each said control member comprises a rigid wire having a hook at said second end, and wherein said sliding plate has a first hole for each said hook, whereby said control members are connected to said sliding plate by insertion of said hooks into said first holes.

5. The machine of claim 6 wherein said sliding plate has an elongate second hole for each said core, each said core extending through one said second hole and into engagement with one said rigid wire.

* * * * *